US006638043B1

(12) United States Patent
Khalifa

(10) Patent No.: US 6,638,043 B1
(45) Date of Patent: Oct. 28, 2003

(54) DIFFUSER FOR HIGH-SPEED SCREW COMPRESSOR

(75) Inventor: E. Ezzat Khalifa, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/186,954

(22) Filed: Jun. 28, 2002

(51) Int. Cl.[7] ..... F04C 18/16

(52) U.S. Cl. ..... 418/201.1; 418/181; 415/207; 415/211.2

(58) Field of Search ..... 418/181, 201.1; 415/207, 211.2, 224.5

(56) References Cited

U.S. PATENT DOCUMENTS 2,474,653 A * 6/1949 Boestad ..... 418/201.1
4,668,252 A * 5/1987 Gerdau ..... 415/169.2
4,957,417 A * 9/1990 Tsuboi ..... 418/201.1

FOREIGN PATENT DOCUMENTS

JP 54-54309 * 4/1979 ..... 418/201.1
JP 4-175488 * 6/1992 ..... 418/201.1

* cited by examiner

*Primary Examiner*—John J. Vrablik
(74) *Attorney, Agent, or Firm*—Bachman & LaPointe

(57) ABSTRACT

A screw compressor including a housing containing at least one rotor for generating a discharge flow in a discharge direction; a diffuser member communicated with the housing to receive the discharge flow, the diffuser extending from the housing in the discharge flow direction, the diffuser having a converging collecting section, a diffuser throat downstream of the collecting section and a diffusing section downstream of the throat, whereby the discharge flow can be collected and diffused in the discharge flow direction.

6 Claims, 1 Drawing Sheet

DIFFUSER FOR HIGH-SPEED SCREW COMPRESSOR

BACKGROUND OF THE INVENTION

The invention relates to screw compressors and, more particularly, to a screw compressor and diffuser structure wherein kinetic losses are reduced.

The compression process in a screw compressor occurs within rotating pockets. Kinetic energy is imparted to compressed gases. To reduce dissipative effects of leakage in these machines, and to reduce their size and cost, it is desirable to run them at high tip speeds. The optimum tip speed of these machines depends among other factors, upon the relative balance between leakage losses, which decrease at high speeds, and viscous and kinetic losses, which increase at high speed. In an oil-less or near oil-less machine, the viscous losses are of minor concern, and tip speed is limited by kinetic losses which increase with the square of speed. Higher tip speeds could be obtained in screw compressors if part of the leaving kinetic energy could be efficiently recovered in an exit diffuser. This is done, for example, with turbo-compressors wherein the discharge flow is much better directed by the blades and flow distortion is tolerable.

Screw compressors, on the other hand, have a much more complex flow at their discharge port(s), with unfavorable flow directions and, possibly, high circulatory structure. The complex geometry of the discharge port relative to the rotors and housing makes it much more difficult to guide the flow efficiently to a diffuser throat. This is in part due to the highly tangential components of flow discharged in opposite tangential or radial directions from the meshed rotors of the compressor.

It is clear that the need remains for an improved structure for guiding discharge flows from the compressor so as to improve compressor efficiency.

It is therefore the primary object of the present invention to provide such a structure.

Other objects and advantages of the present invention will appear hereinbelow.

SUMMARY OF THE INVENTION

In accordance with the present invention, the foregoing objects and advantages have been readily attained.

According to the invention, a screw compressor is provided which comprises a housing containing at least one rotor for generating a discharge flow in a discharge flow direction; a diffuser member communicated with said housing to receive said discharge flow, said diffuser extending from said housing in said discharge flow direction, said diffuser having a converging collecting section, a diffuser throat downstream of said collecting section and a diffusing section downstream of said throat, whereby said discharge flow can be collected and diffused in said discharge flow direction. According to a preferred embodiment, the discharge flow direction is a substantially radial direction with respect to the rotor.

BRIEF DESCRIPTION OF THE DRAWINGS

A detailed description of preferred embodiments of the present invention follows, with reference to the attached drawings, wherein.

DETAILED DESCRIPTION

The invention relates to screw compressors and, more particularly, to a compressor and diffuser structure which provides for efficient operation of high-speed oil-less or near oil-less screw machines.

In accordance with the present invention, a diffuser is provided which is oriented to extend in the same direction as discharge flow from the rotors of a compressor such that discharge flow from the compressor is collected and diffused without substantial turning or the like. In the preferred embodiment, the discharge flow is discharged in a substantially radial direction with respect to the rotors, and the diffuser extends in this direction. The remaining disclosure is given in connection with this embodiment.

Figure 1:
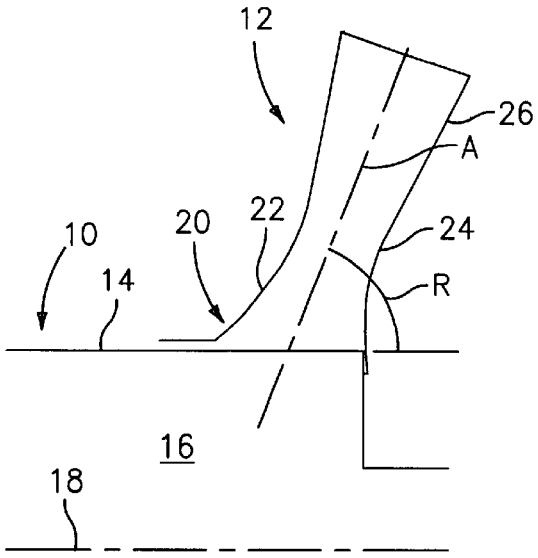
FIG. 1 is a side-schematic view of a compressor with diffuser in accordance with the present invention.

FIG. 1 schematically illustrates a portion of a compressor 10 and a diffuser 12 in accordance with the present invention. As shown, compressor 10 may suitably have a housing 14 and at least one rotor 16 rotating about an axis 18 so as to compress gas as desired and generate a discharge flow in a substantially radial direction.

Figure 2:
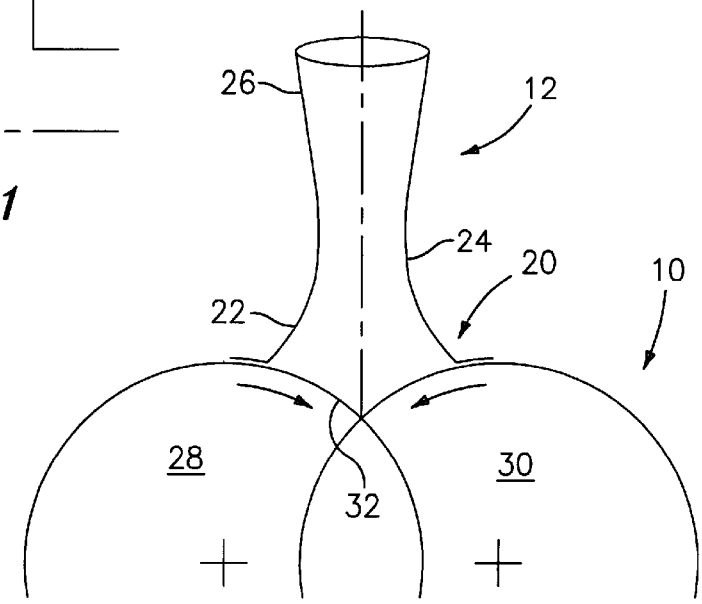
FIG. 2 is an end view of a compressor with diffuser in accordance with the present invention.

FIGS. 1 and 2 illustrate side and end views of a portion of compressor 10 along with diffuser 12 positioned therein for operation in accordance with the present invention.

According to the invention, diffuser 12 has an inlet portion 20 which is advantageously adapted to receive discharge flow from compressor 10 in a substantially radial direction. Inlet portion 20 leads to a collecting portion 22 of diffuser 12 which leads to a diffuser throat 24 followed by a diffusing section 26. In accordance with the present invention, diffuser 12, and preferably collecting portion 22 and diffusing section 26 thereof, are arranged along a substantially radial direction R as illustrated in FIG. 1. Discharge flow from rotors of screw compressor 10 will have a substantially radial flow direction, with a possible axial component as well, and an angle R between a line parallel to axis 18 and an axis A of diffuser 12 is preferably between about 45 and about 90°.

As best shown in FIG. 2, compressor 10 may have a housing 14 containing more than one rotor, in this case two rotors 28, 30, each of which generates a substantially radially directed discharge flow. According to the invention, diffuser 12 is mounted to a substantially V-shaped discharge port 32 of housing 14 for receiving discharge flow from each of rotors 28, 30 both in a substantially radial direction as desired.

From diffuser throat 24, diffuser 12 advantageously has a cross-sectional flow area which increases in a flow direction.

Figure 3:
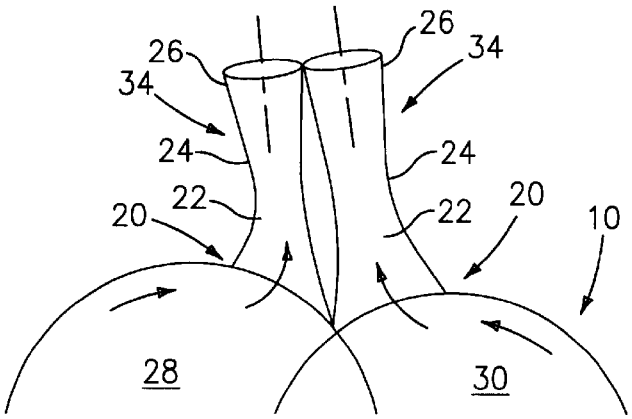
FIG. 3 schematically illustrates a preferred embodiment of the present invention.

Turning now to FIG. 3, an alternative embodiment of the present invention is shown. In connection with compressors 10 having multiple rotors 28, 30, it may be desirable to provide a plurality of diffusers 34 such that a single diffuser 34 is adapted to receive the discharge flow from each rotor 28, 30. In this way, collection and diffusing can be conducted in parallel, and the radial extent of diffuser 12 in accordance with the present invention can be reduced. FIG. 3 shows an embodiment wherein two rotors 28, 30 are present, and wherein two diffusers 34 are incorporated into the device. One diffuser 34 is communicated with each of rotors 28, 30 as desired. The embodiment of FIG. 3 advantageously allows for enhanced efficiency of compressor operation with a smaller space occupied as compared to the embodiment of FIGS. 1 and 2.

It should readily be appreciated that a compressor and diffuser have been provided in accordance with the present invention wherein discharge flow from the compressor, and more specifically discharge flow from rotors within the compressor, is collected and diffused in a substantially radial flow direction such that losses in kinetic energy, for example due to high tip speeds of the compressor, can be offset by increased efficiency in guiding the flows to the diffuser.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing containing at least one rotor for generating a discharge flow in a discharge flow direction;

a diffuser member communicated with said housing to receive said discharge flow, said diffuser extending from said housing in said discharge flow direction, said diffuser having a converging flow area collecting section, a diffuser throat downstream of said collecting section and a diffusing flow area section downstream of said throat, and said collecting section, said diffuser throat and said diffusing section all extending in a substantially straight line along said discharge flow direction whereby said discharge flow can be collected and diffused in said discharge flow direction.

2. The apparatus of claim 1, wherein said discharge flow direction is a substantially radial direction with respect to said rotor.

3. The apparatus of claim 1, wherein said collecting section and said diffusing section extend in said discharge flow direction.

4. The apparatus of claim 1, wherein said housing has a substantially circumferential discharge port and wherein said diffuser member extends substantially radially from said discharge port.

5. A screw compressor, comprising:

a housing containing at least one rotor for generating a discharge flow in a discharge flow direction;

a diffuser member communicated with said housing to receive said discharge flow, said diffuser extending from said housing in said discharge flow direction, said diffuser having a converging collecting section, a diffuser throat downstream of said collecting section and a diffusing section downstream of said throat, whereby said discharge flow can be collected and diffused in said discharge flow direction, wherein said housing contains at least a first rotor and a second rotor each of which generates a discharge flow in a discharge flow direction, and wherein said diffuser member comprises at least a first diffuser and a second diffuser each positioned to receive said discharge flow from a respective rotor.

6. The apparatus of claim 5, wherein said first diffuser and said second diffuser extend from said housing substantially parallel to each other.

* * * * *